United States Patent [19]

Stubbings

[11] 4,424,618

[45] Jan. 10, 1984

[54] ASSEMBLY OF STRAIGHT DUCT AND TRANSITIONS

[75] Inventor: James H. Stubbings, Rockville, Md.

[73] Assignee: Potomac Applied Mechanics, Inc., Bethesda, Md.

[21] Appl. No.: 898,458

[22] Filed: Apr. 20, 1978

Related U.S. Application Data

[62] Division of Ser. No. 788,641, Apr. 18, 1977, Pat. No. 4,111,143.

[51] Int. Cl.[3] ..... B21D 39/00

[52] U.S. Cl. ..... 29/509; 29/243.5; 29/514; 29/729; 29/788; 29/819

[58] Field of Search ..... 29/779, 788, 509, 793, 29/514, 515, 796, 243.5, 819; 138/157; 113/54, 57, 58

[56] References Cited

U.S. PATENT DOCUMENTS

| | | | |
|---|---|---|---|
| 854,397 | 5/1907 | Black | 138/57 |
| 873,144 | 12/1907 | Wright | 138/157 |
| 2,316,166 | 4/1943 | Huguelet | 13/157 X |
| 2,950,697 | 8/1960 | Flagler | 113/54 |
| 3,015,293 | 1/1962 | Parham | 113/54 |
| 3,722,443 | 3/1973 | Anderson et al. | 113/54 |
| 3,840,960 | 10/1974 | Toti | 29/779 |
| 3,886,981 | 6/1975 | Eliason | 138/163 |
| 4,086,522 | 4/1978 | Engelberger et al. | 29/701 X |

*Primary Examiner*—Leon Gilden

*Attorney, Agent, or Firm*—Cushman, Darby & Cushman

[57] ABSTRACT

A method for formation of duct from preformed pieces. A number of ductwork pieces are formed out of sheet material, the pieces having edge configurations adapted to interlock with each other to form a seam of a completed duct. The individual pieces are fed into an edge interlocking machine and are acted upon by the machine to form a duct having a predetermined length. The machine includes a stationary frame member, guide rails elongated in the direction of ductwork movement through the machine, rollers associated with at least some of the guide rails for effecting interlocking of the edge configurations of the duct work pieces to form duct seams, and structure for mounting the guide rails to the frame member. The guide rails are relatively movable with respect to the frame member and to each other to form ducts of different sizes and so that transition ducts can be formed as well as straight duct. The machine may be made portable and the ductwork pieces transported to job site in a low volume configuration and assembled by the portable machine at the job site.

7 Claims, 21 Drawing Figures

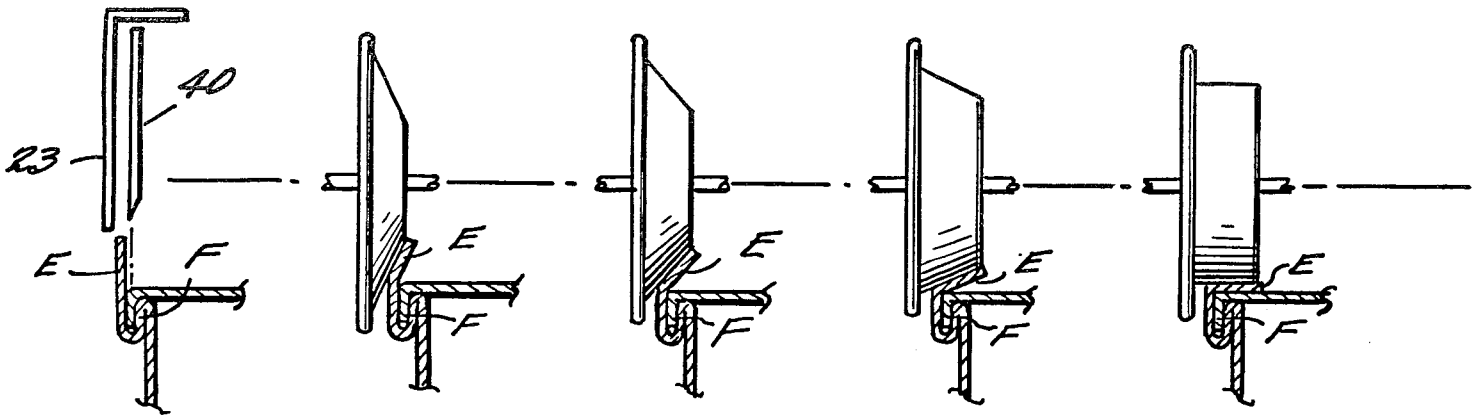
Fig. 2a
Fig. 2b
Fig. 2c
Fig. 2d
Fig. 2e
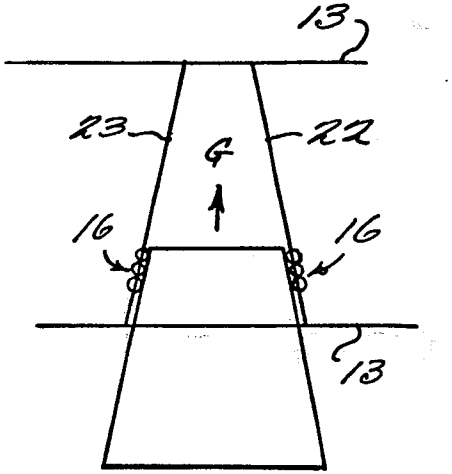
Fig. 3a
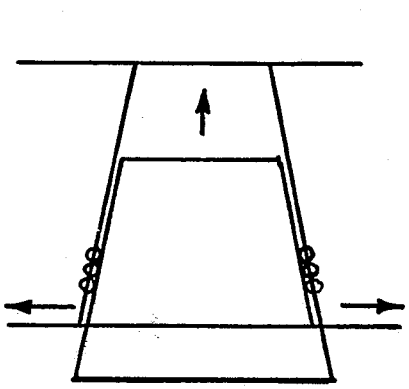
Fig. 3b
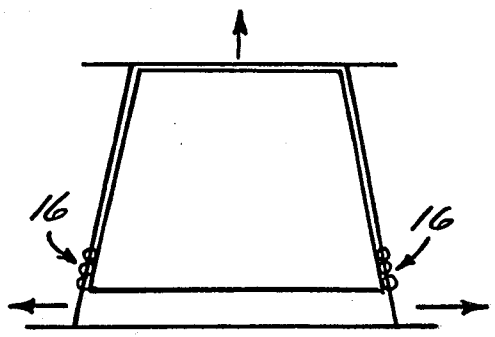
Fig. 3c

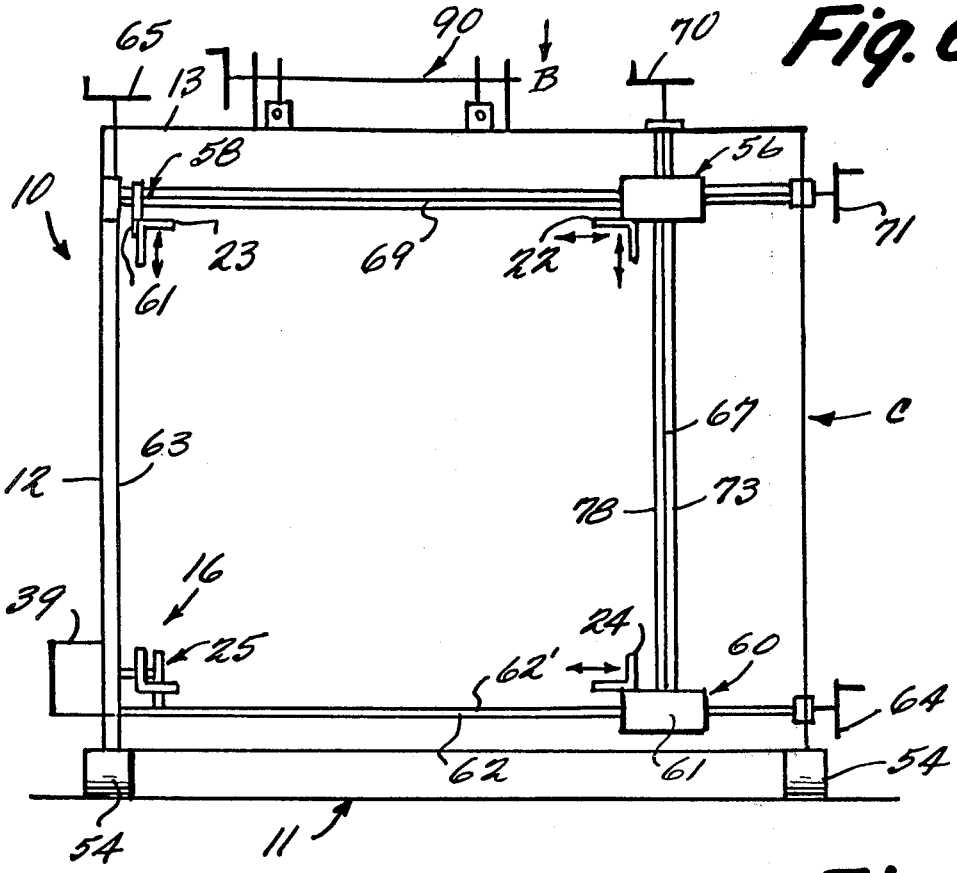
Fig. 6
Fig. 7
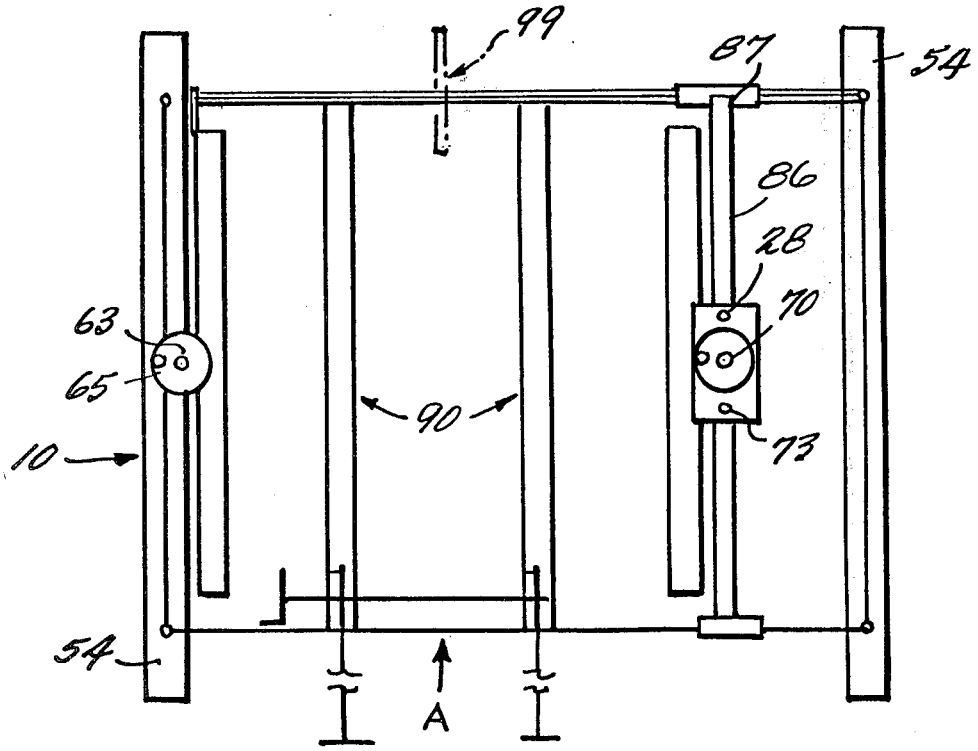

ASSEMBLY OF STRAIGHT DUCT AND TRANSITIONS

This is a division, of application Ser. No. 788,641 filed Apr. 18, 1977, now U.S. Pat. No. 4,111,143.

BACKGROUND AND SUMMARY OF THE INVENTION

The invention relates to the construction of duct from ductwork pieces that have been formed with interlocking edge configurations. The common present practice is to form individual ductwork pieces at a factory site, and then using air hammers or other hand tools, assemble the ductwork pieces together by effecting interlocking of cooperating edge configurations thereof to form a completed duct. Such hand assembly can be time consuming and inefficient, and when assembly is made at a factory site, only relatively small amounts of material can be transported to the job site in each truck load since the trucks carry mostly air when they are transporting the completed ducts. There have been proposals (see U.S. Pat. No. 3,636,903 for example) for the automatic formation of straight duct, however such proposals require relatively large and complicated machines which are not readily adaptable to produce duct of different sizes, and are incapable of producing transition pieces.

According to the present invention, a method is provided which allow the automatic assembly of straight duct of all different sizes, and additionally allow the formation of transition pieces. According to one aspect of the present invention, duct work pieces may be formed at the factory site with the necessary edge configurations and transported in low volume configurations to the job site where they may be automatically assembled by a portable machine at the job site, the machine being simple to operate and susceptible of operation by only one or two operators. It is believed that the method and apparatus according to the present invention can result in significant time savings in duct assembly compared to the prior art while still being capable of assembly of a wide variety of duct sizes (including transition pieces), and can result in significant energy gains when the duct is transported to the job site in a low volume configuration.

According to one aspect of the present invention there is provided a method for forming a duct using an edge interlocking machine having rollers comprising the steps of: forming a plurality of ductwork pieces, each having a predetermined length, out of sheet material; forming at least one of the pieces so that it has an edge configuration adapted to be acted upon to interlock and form a seam with another piece to form the duct; feeding the plurality of pieces into the edge interlocking machine; and acting upon the at least one edge configuration so that it forms a seam with another piece to form a duct having the predetermined lengths. The edge configuration preferably is a Pittsburgh edge configuration, although a snap lock may be employed. A completed duct can be assembled from 2, 3, or 4 pieces. According to another aspect of the present invention, a method of forming ductwork for installation in a building at a job site is provided which uses a portable fabrication machine. The method comprises the steps of: forming duct work pieces out of sheet material, including forming at least one of the pieces so that it has an edge configuration adapted to interlock and form a seam with another piece to form a duct; transporting the ductwork pieces in an unassembled, low volume configuration to the job site; and interlocking the edge configurations of at least two of the pieces of ductwork to form a seam of a completed duct by operating on the pieces with the portable fabrication machine at the job site.

It is a primary object of the present invention to provide a method and apparatus for automatic assembly of duct from ductwork pieces. This and other objects of the invention will become clear from an inspection of the detailed description of the invention, and from the appended claims.

BRIEF DESCRIPTION OF THE DRAWINGS

FIGS. 2A through 2E are schematic showings of structures for acting on a duct pittsburgh edge configuration, with the duct edge configuration projected below each piece of apparatus;

FIGS. 3A through 3C are schematic showings illustrating the use of the apparatus of FIG. 1 to form a transition duct;

FIG. 6 is a front schematic view of a portable machine for practicing the method according to the present invention;

FIGS. 7 and 8 are top plan and side views respectively of the structure of FIG. 6 taken along arrows B and C respectively of FIG. 6;

DETAILED DESCRIPTION OF THE INVENTION

Figure 1:
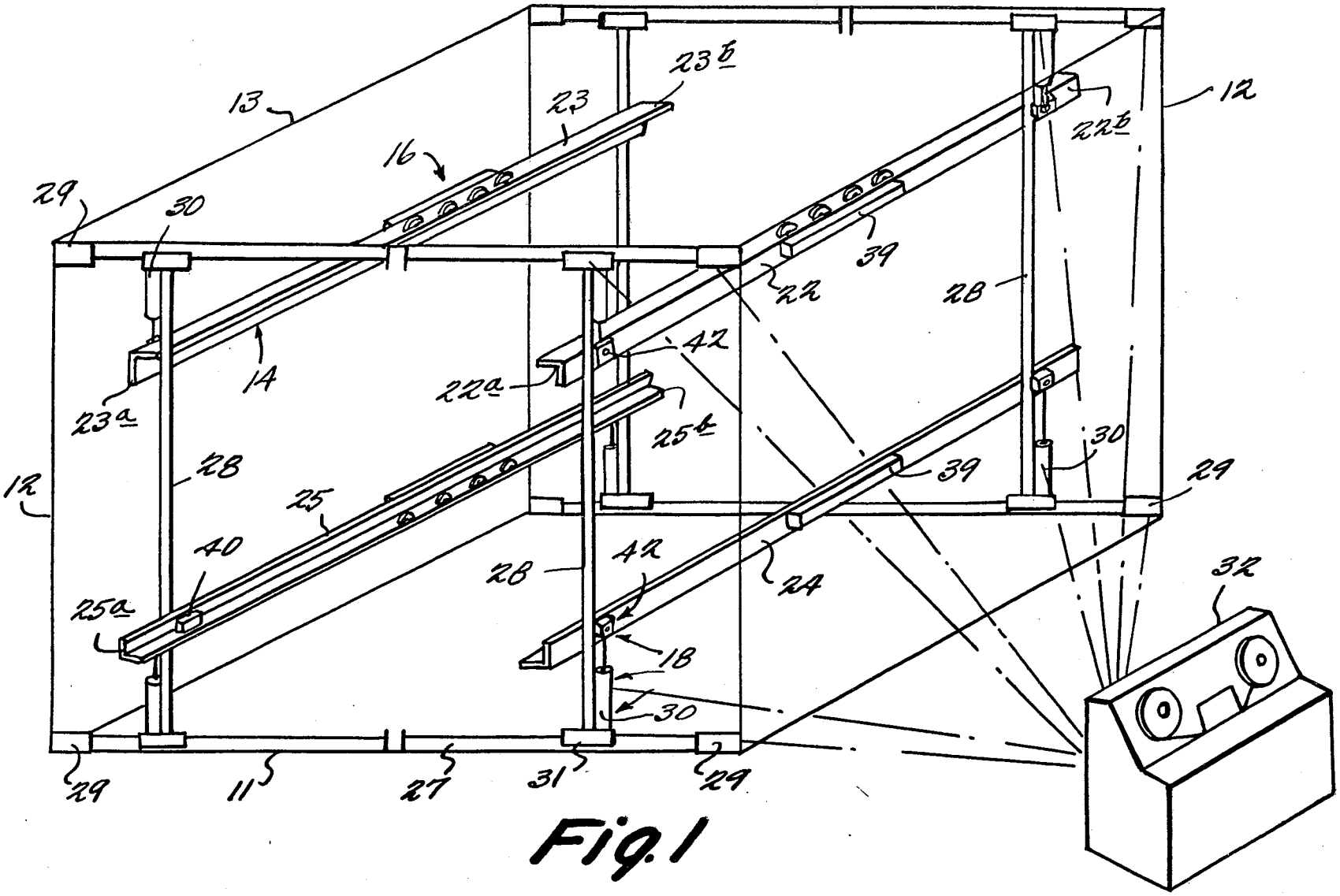
FIG. 1 is a schematic perspective view of exemplary apparatus for practicing the method according to the present invention for forming straight ducts and transition.

Exemplary apparatus for effecting interlocking of edge configurations of ductwork pieces to form a completed duct according to the present invention is illustrated schematically in FIG. 1. It is to be understood that the drawings only provide schematic illustrations of the invention, and the component parts thereof may differ in dimension and shape from those illustrated in the drawings. The apparatus for practicing the method according to the present invention basically includes a frame member 10 including a bottom frame 11, side frame members 12, and top frame members 13. Means shown generally at 14 are provided for guiding the movement of ductwork pieces to be formed into duct with respect to the frame member 10, the guiding means comprising a plurality of guide rails, each guide rail being elongated in the direction of movement of ductwork pieces with respect to the stationary frame 10. The guide rails include a first upper guide rail 22 having ends 22*a* and 22*b* thereof, a second upper guide rail 23 having ends 23*a* and 23*b* thereof, a first lower guide rail 24 having ends 24*a*, 24*b* thereof, and a second lower guide rail 25 having ends 25*a* and 25*b* thereof. The apparatus also includes roller means 16 asociated with the guiding means 14 for effecting interlocking of edge configurations of duct work pieces to form duct seams, and mounting means 18 for mounting the guide rails 22 through 25 with respect to the frame member 10.

The apparatus of FIG. 1 is adjustable to assemble duct of a wide variety of sizes, and also to make transitions as well as straight duct. The rails 22 through 25 are preferable mounted so that they are movable both horizontally and vertically with respect to the frame member 10 and with respect to each other. The mounting means 18 may comprise a plurality of generally horizontally extending screw rods 27 or the like, one associated with each end of each rail 22 through 25, and a plurality of generally vertically extending rods 28 each rod 28 connecting a corresponding end of one upper guide rail with a corresponding end of a lower guide rail. As an inspection of the drawings makes clear, the second upper guide rail 23 is disposed in generally the same horizontal plane as the first upper guide rail 22, the first lower guide rail 24 is disposed in generally the same vertical plane as the first upper guide rail 22, and the second lower guide rail 25 is disposed in generally the same vertical plane as the second upper guide rail 23 and is disposed in generally the same horizontal plane as the first lower guide rail 24. Power means 29 and 30 respectively are associated with the screws 27 and vertical rods 28. Preferably the power means 29 comprises a rotary motor for rotating a screw rod 27 and a device 31 is provided for translating rotary motion of the screw rod 27 into reciprocal movement of a rod 28 attached to a pair of devices 31. The structure 31 can be any conventional device for effecting this function such as the traveling nut shown in U.S. Pat. No. 3,745,840. The power means 30 may comprise a hydraulic cylinder or the like which is capable of moving a rail into a given position and holding it securely in that position. Preferably, enough structures 27, 28, 29, 30 and 31 are provided so that each end of each rail is movable with respect to each end of each other rail. In this way, not only can the rails adapt to accommodate and form ducts of a wide variety of sizes, transitions can also be formed therewith. All of the power means 29, 30 can be connected up to a common control means 32 as shown schematically in FIG. 1. [It is noted that in FIG. 1, for the sake of clarity, only some of the means 29, 30 have been illustrated as connected up to the control means 32 although in practice all of the means 29, 30 would be operatively connected to the control means 32 and/or synchronized.] The means 32 may comprise a conventional industrial computer or the like.

Conventional duct normally has a pittsburgh edge configuration so that the roller means 16 will effect bending of an upstanding portion of the Pittsburgh lock to effect the interlock. The rollers may also be useful with snap lock duct connections, however, in such cases snapping the ductwork pieces together. Exemplary roller means 16 that are utilizable according to the present invention are shown schematically in FIG. 2 including a first roller 34, a second roller 35, a third roller 36, and a fourth roller 37. Roller means 16 need not be associated with each guide rail 22 through 25, but only as many roller means 16 are provided as is necessary to effect fabrication of the particular duct work pieces that are to be assembled to form the duct. Exemplary duct work piece configurations that may be assembled into ducts according to the teachings of the present invention are ilustrated in FIGS. 12A through 12D, including two different types of two-piece configurations, a three-piece configuration, and a four-piece configuration. Other ductwork piece configurations could also be assembled according to the present invention.

FIGS. 2B through 2E show the rollers 34 through 37 acting on an upstanding piece E of a pittsburgh lock to effect the interlocking according to the invention. The first roller 34 bends the portion E slightly away from the vertical, the second roller 35 bends it further away from the vertical, and the rollers 36 and 37 further act on it so that it is flattened and captures the quarter edge F of a cooperating duct work piece to form the duct seam. All of the rollers may be driven by a common motor 39 or the like, connected by gears to each roller shaft, the motor 39 comprising an electric motor or the like mounted directly on a guide rail 22 through 25 with which the roller means 16 are associated. Additionally, in order to provide for smooth automatic operation of the apparatus according to the invention, it is desirable to have a knife blade or wheel 40 (see FIG. 1 and FIG. 2A) for keeping the pittsburgh lock open so that the quarter edge F will enter the pittsburgh lock easily. The blade 40 is located in front of the first roller 34 as can be seen from an inspection of FIG. 1.

The operation of the apparatus of FIG. 1 to form a duct is made readily apparent by FIGS. 3A through 3B which are step-by-step top plan schematic showings of the apparatus of FIG. 1 used to make a transition. The operator of the apparatus inserts the leading portion of each quarter edge that is to be inserted in a pittsburgh lock into the leading portion of the cooperating pittsburgh lock, and the leading portions of the pieces are moved into operative relationship with the rails 22 through 25. The rails 22 through 25 have been moved by the power means 29 and 30—as controlled by the control means 32—so that they are in proper position to receive the duct work pieces.

The operator pushes the duct pieces into engagement with the rails 22 through 25 and the roller means 16, and the combination of the operator pushing motion and the self-feeding action of the rollers 34 through 37 moves the ductwork pieces along the rails. The knife blades 40 hold the respective Pittsburgh locks open to make sure that the quarter edges are disposed within the locks before the roller means 16 are brought into play, and the roller means 16 bend the upstanding portion E of the pittsburgh lock into locking engagement as shown in FIGS. 2B through 2E. When a transition is being formed, as shown in FIGS. 3A through 3C, the rails 22 and 23, and the rails 24 and 25, are moved with respect to each other as shown in FIGS. 3B and 3C. The rails 22 and 24, and the rails 23, 25, can also be moved relative to each other so that they assume the same relationship as the rails 22 and 23 shown in FIGS. 3A through 3C if desired. The computer control means 32 automatically—by preprogramming thereof—effects the relative movement between the various rail members to form the transition as shown in FIGS. 3A through 3C.

Figure 4:
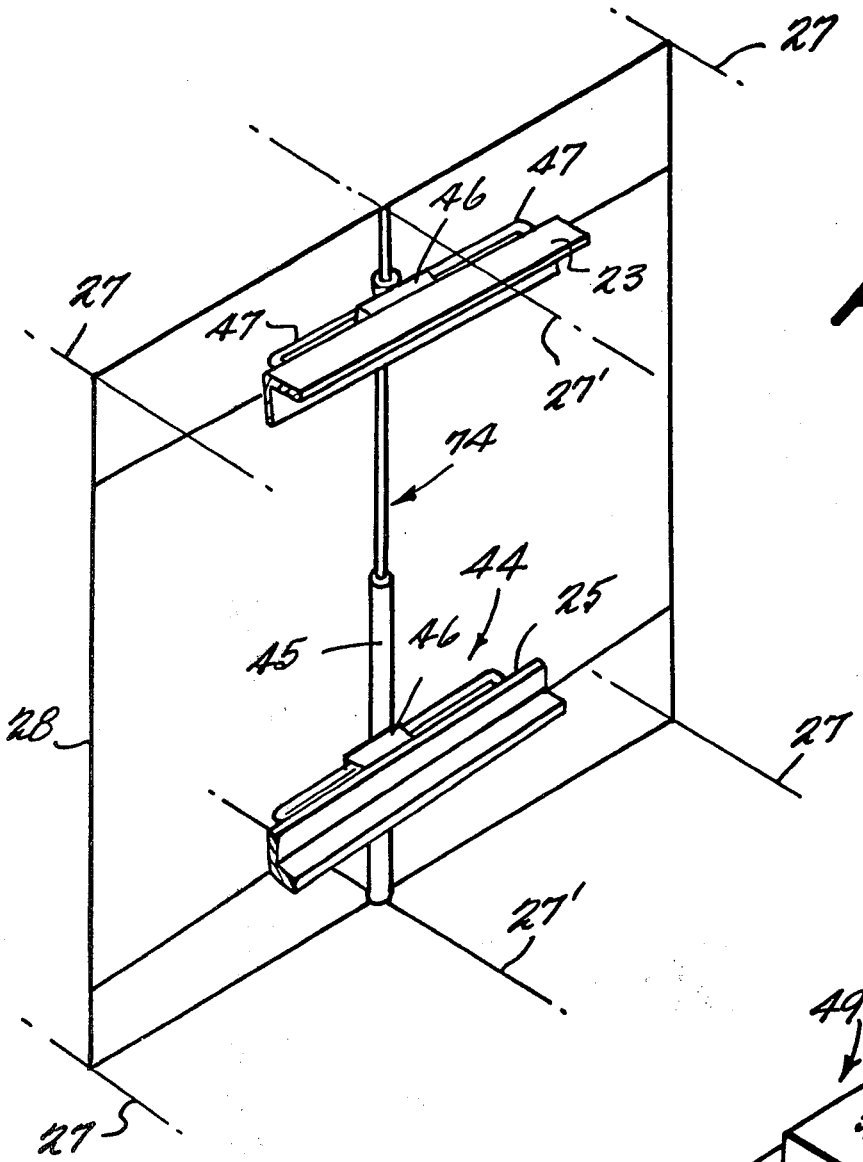
FIG. 4 is a schematic perspective view of an accessory supporting structure that could be utilized in the structure of FIG. 1 if the guide rails were long enough so that they had a tendency to sag.

To form transitions according to the method of the present invention the rails must be mounted to the rods 28 to allow for the relative movement between the ends thereof as shown in FIGS. 3A through 3C. This is accomplished by providing conventional pivotal means 42 for pivotally mounting the rail ends to the vertically extending rods 28 so that the rail ends are pivotal about both vertical and horizontal axes.

Where the rails 22 through 25 are long enough so that they might encounter some sagging problems (especially with the motors 39 associated therewith) support means may be provided to prevent sagging. Such support means are shown schematically in FIG. 4 generally at 44, the support means including a vertically disposed telescoping support rod 45 and means 46 for operatively mounting the rod 45 to each rail of a set 23, 25 or 22, 24 of rails so that the rails may move angularly with respect to each other in a generally vertical plane, the mounting means comprising conventional pivots. Rods 47 extend from the support means 46 and engage spaced portions of the respective rails, i.e., rails 23 and 25 as shown in FIG. 4, to support the middle portion thereof. Screw rods 27' corresponding to the screw rods 27, or simple guide rods, can be provided to allow for sliding movement of the vertical support rod 45 with respect to the frame 10.

Figure 5:
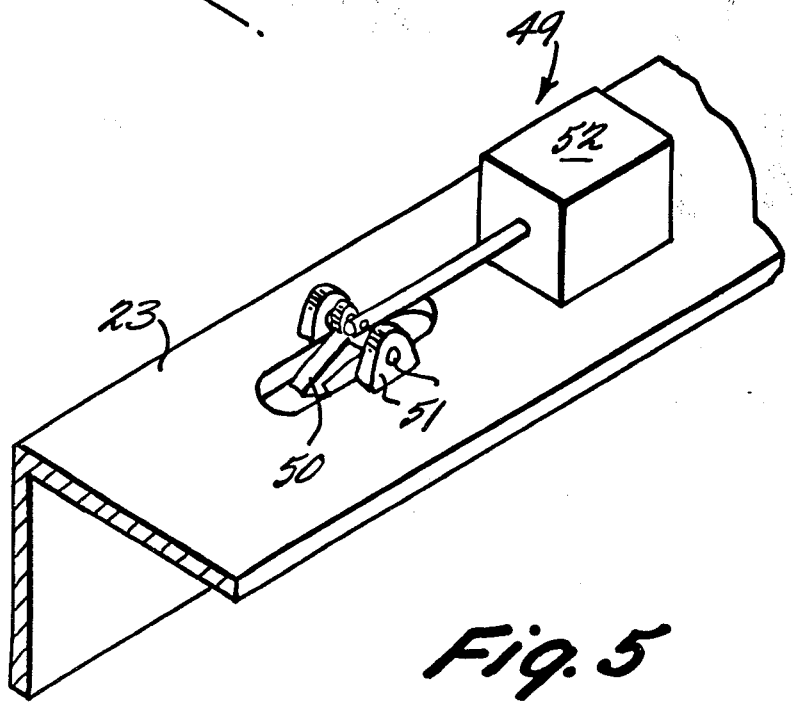
FIG. 5 is a perspective detailed view of an advancing structure that may be utilized in the structure of FIG. 1.

In some circumstances it might be desirable to provide accessory means—that is accessory to the self-feed of the roller means 16 and accessory to the operator pressure—for advancing ductwork pieces in direction G to form a completed duct. Such accessory advancing means are shown generally at 49 in FIG. 5. Such means may include a ductwork piece engaging finger 50 having a suitable configuration for engaging and applying an advancing force to a piece of ductwork, means 51—including a pivot rod—for mounting the finger 50 for pivotal movement with respect to a rail (23 in FIG. 5) to which it is connected, and power means such as a reciprocal motor 52 for oscillating the finger 50 about the pivotal mount 51 to engage and then disengage a ductwork piece to effect advancement thereof through the apparatus. A means 49 may be associated with each rail 22 through 25 if desired.

Figure 8:
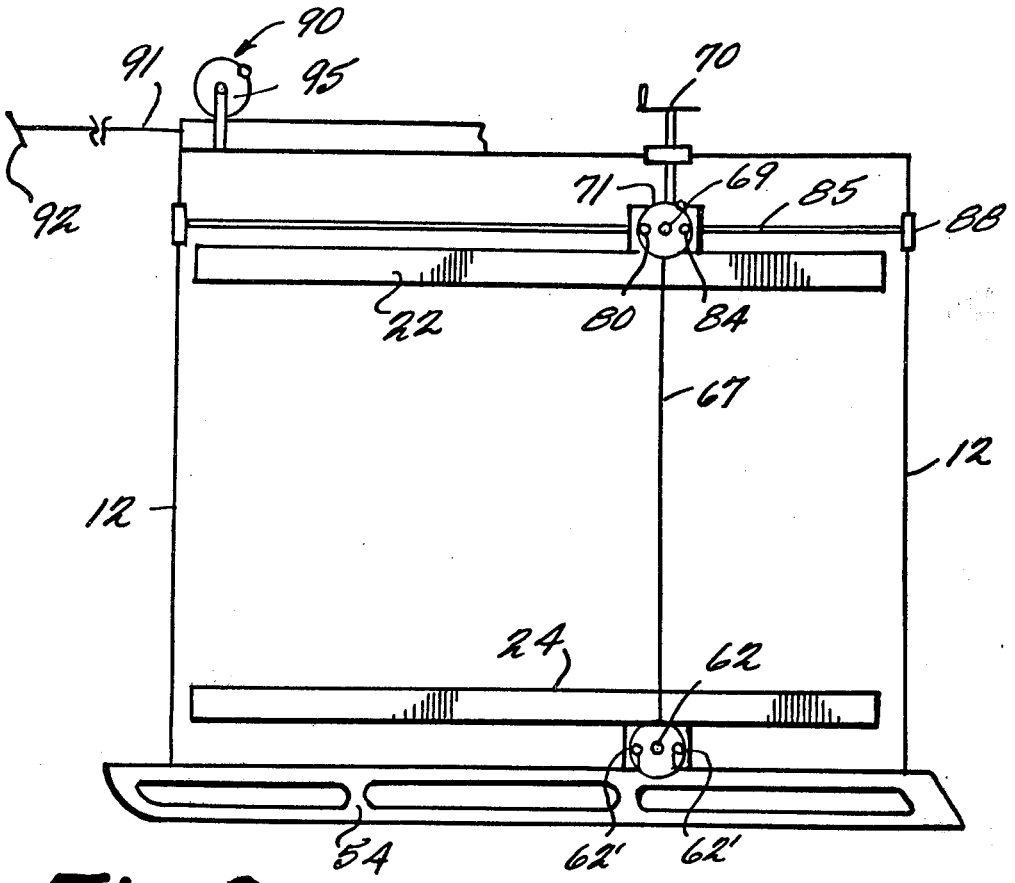

A portable machine for practicing the method according to the present invention is shown schematically in FIGS. 6 through 8. The portable machine has the same general components as the apparatus of FIG. 1 including guide rails 22 through 25 and appropriate roller means 16, frame member 10, etc. The portable machine is not capable of forming transitions, however, since the capability of forming transitions would make it too complicated to be used at a job site for the fabrication of duct as contemplated by the present invention. The frame member 10 of the portable machine in FIGS. 6 through 8 preferably is small enough so that it can be mounted on the back of a pick-up truck or the like and transported to a job site, as for instance by having height and width dimensions of about 6' or less. The bottom 11 of the portable machine includes a pair of skids 54 connected together by various cross members. All of the frame components of the frame member 10—which are shown only schematically in the drawings—preferably are perforated to reduce the weight of the machine. A perforated skid 54 is shown in FIG. 8.

The portable machine includes means 56 for mounting one of the guide rails (22) with respect to the frame member 10 so that it is movable both horizontally and vertically with respect to the frame member 10, mounting means 58 for mounting another of the guide rails (23) so that it is movable vertically with respect to the frame member 10, and mounting means 60 for mounting a third guide rail (24) so that it is movable horizontally with respect to the frame member 10. The means 58 and 60 preferably comprise traveling nut assemblies 61, such as the assemblies 31 of FIG. 1 (such as the traveling nut shown in U.S. Pat. No. 3,745,840) mounted on screw rods 62, 63 respectively so that rotational movement of the screw rods 62, 63 respectively—as with convenient hand cranks 64, 65 respectively—results in linear movement of the nuts 61. Additionally, guide rods 62', 63' respectively are associated with the rods 62, 63 to insure true linear movement of the traveling nuts 61. Although only one rod 62, 63 with associated traveling nut 61 is shown associated with each rail 24, 23, it is to be understood that if the length of the rail members 24, 23 warranted it, more than one rod 62, 63 could be provided for each rail 24, 23 although this would make operation of the machine by a single operator more difficult.

Figure 9:
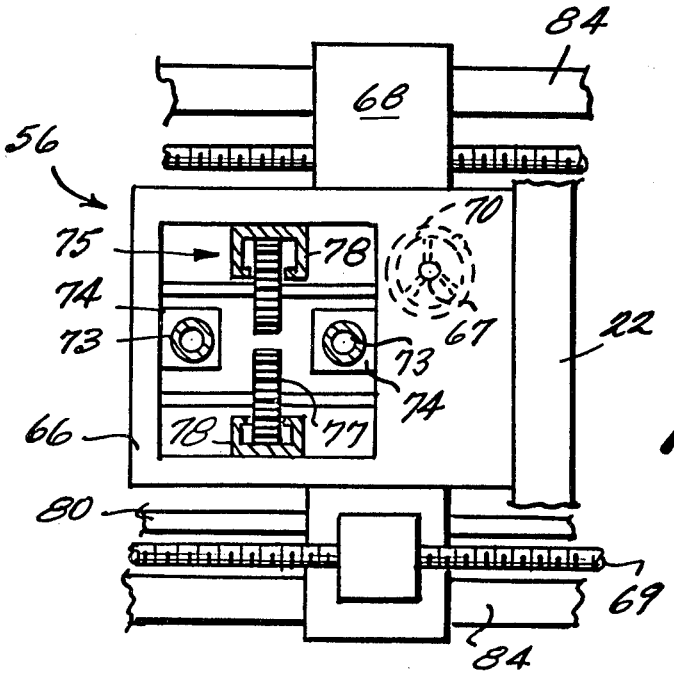
FIG. 9 is a top view of one of the rail mounting structures of FIG. 6.
Figure 10:
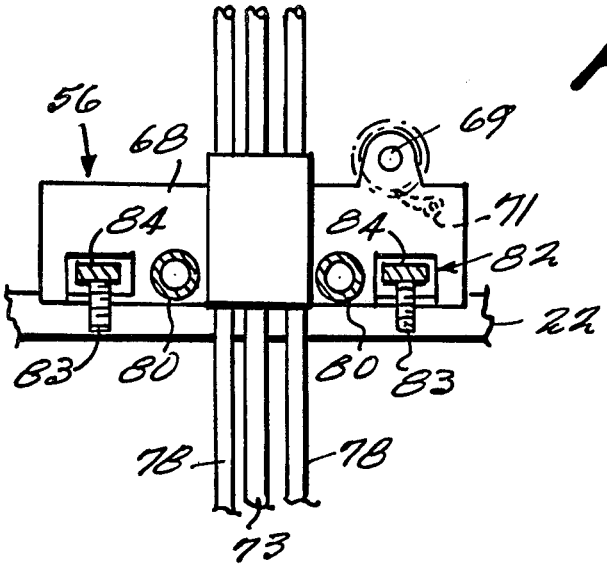
FIG. 10 is a detailed side view of the structure of FIG. 9.

The means 56 according to the present invention is really just a combination of a pair of perpendicularly disposed traveling nuts with associated guide rods and detent means, and is shown in details in FIGS. 9 and 10.

FIG. 9 is a top plan view of an exemplary means 56 according to the present invention, while FIG. 10 is a side view of such means. The structure 56 comprises two major parts, a first part 66 which cooperates with vertically extending screw rods 67 to provide for adjustment of the guide rail in the vertical direction, and a second part 68 which cooperates with a horizontally extending screw rod 69 to provide for adjustment of the guide rail 22 in the horizontal direction. It is necessary to provide some sort of guide arrangement for the structures 66, 68 to provide movement thereof along the screw rods 67, 69, and additionally it is desirable to provide some sort of detent means for holding the structures 66, 68 in place when they are moved to a given position. The guide structure for the components 66 includes one or more vertically extending guide rod 73 received by guide collars 74 attached to the structure 66. Detent means for the structure 66 are shown generally at 75 and may include one or more male ratchet member 77 cooperating with one or more female ratchet members 78 which vertically extend parallel to the guide rods 73. The guide rods and ratchets are only shown very schematically in FIG. 6. A hand wheel 70 is provided for rotation of the screw rods 67, the structure 66 for receiving the screw rods 67 transforming the rotational movement of the rods 67 into linear movement. As shown in FIG. 7, the rod 67—and the guide rods 73 and female ratchets 78—are supported at the top thereof to the frame by a cross member 86 and guide collars or brackets 87 which are adapted to slide on the top 13 of the frame member 10. The screw 67 and the structures 73, 78 are supported at the bottom thereof the traveling nuts 61.

The structure 68, as shown most clearly in FIG. 10, also includes one or more guide rods 80 received thereby, with male ratchet members 83 mounted to the portion 68 cooperating with horizontally extending female ratchet members 84. As shown most clearly in FIG. 8, the screw rods 69, guide rod 80 and female ratchet 84 are supported at one end by a cross rod 85 connected to the side frame members 12 by guide collars or brackets 88, and connected at the other end thereof to the traveling nuts 61 associated with the screw shaft 63. A hand crank 71 also is provided for the rods 69, the portion 68 transforming rotary movement of the rods 69 into linear movement of the angle 22.

Figure 11:
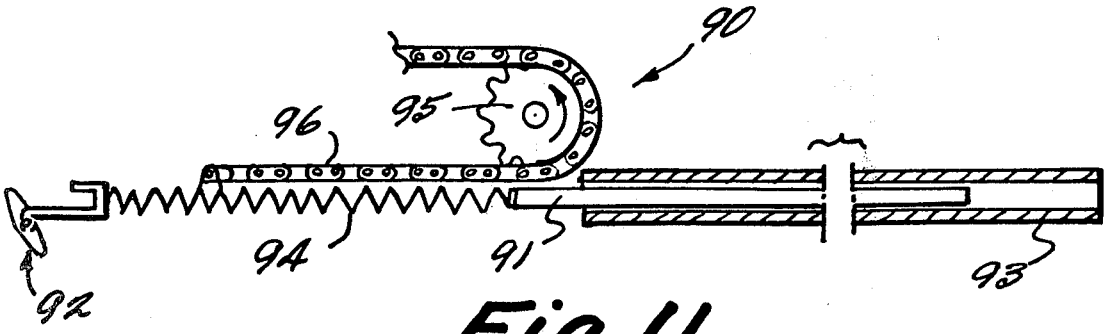
FIG. 11 is a detailed schematic view of the duct portion means of FIG. 6.
Figure 12A:
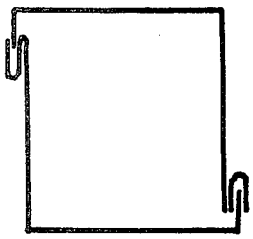
FIGS. 12A through 12D are schematic showings of different sets of ductwork pieces which may be assembled according to the present invention.
Figure 12B:
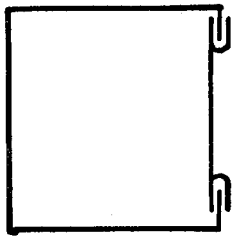
Figure 12C:
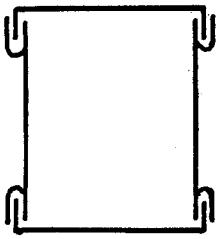
Figure 12D:
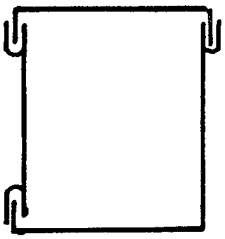

As shown in FIG. 11, it is also desirable to provide a means for assisting the operator in pushing the duct pieces through the machine. Such structure is shown generally at 90 in FIGS. 6 through 8 and 11. Preferably, the structure includes one or more arms 91 having spring-pressed clamping fingers 92 on the free end thereof and slidable into a guide assembly 93 mounted on the frame 10 top portion 13. A spring 94 (see FIG. 11) may be provided for biasing the spring clamp 92 and arm 91 to an outward position with respect to the collar 93. The rod 91 is linearly reciprocal, and a suitable means for providing linear reciprocation thereof comprises a drive gear 95 associated with each arm 91 rotatable about an axis generally perpendicular to the direction of linear reciprocation of the rod 91, and a chain 96 operatively connecting the drive gear to the rod 91. A hand crank may be provided for rotation of the gear 95, although it is desirable to provide a power source for rotation of the gear 95. The power source could be arranged so that it was readily detached from the gear 95 after movement of the duct pieces into the frame member 10, so that the spring 94 could return the clamp 92 to a remote position from the frame 10. The length of the rod 91 is dimensioned so that the normal length of ductwork pieces to be encountered may be pushed, entirely into the frame member 10 of the machine. Suitable other ductwork engaging projections besides this spring clamp 92 may be provided.

The portable machine shown in FIGS. 6 through 11 is especially advantageous in reducing energy costs for transportation of ducts to the field since it allows automatic assembly of preformed duct work pieces at the field. Using a portable fabrication machine such as shown in FIGS. 6 through 11, the method may be practiced of forming ductwork pieces out of sheet material, including forming at least one of the pieces so that it has an edge configuration adapted to interlock and form a seam with another piece to form a duct; transporting the duct work pieces in an unassembled, low volume configuration to the job site; and interlocking the edge configuration of at least two of said pieces of duct work to form a seam of a completed duct by operating on said pieces with said portable fabrication machine at the job site. FIGS. 12A through 12D show various duct work pieces that may be formed at a factory site and transported to the job site for fabrication utilizing the portable machine according to the invention. As can be seen from an inspection of FIGS. 12A through 12D, the individual duct work pieces can be stacked together so that they are in a relatively low volume configuration for transportation to a job site so that a much larger number of ducts can be transported to the job site on each vehicle.

In cases where duct formed by the apparatus of FIGS. 6 through 11 is relatively long so that it might have a tendency to sag if unsupported, a supporting arm—shown in dotted line at 99 in FIG. 7—may be provided—the arm supporting the duct after the edges thereof have been seamed. The arm may be pivotal, collapsible, or both so that it can be moved out of interfering relationship with the duct once the entire duct has been formed.

It will thus be seen that according to the present invention a method have been provided for the automatic fabrication of duct from preformed ductwork pieces having edge configurations adapted to be acted upon to interlock with each other. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent procedures and methods.

What is claimed is:

1. A method of automatically forming a duct transition piece using an edge interlocking machine having rollers; comprising the steps of forming a plurality of ductwork pieces each having a predetermined length, out of sheet material, and at least two pieces having opposed sides that are not parallel;

forming at least one of the pieces so that it has an edge configuration adapted to be acted upon to interlock and form a seam with another piece to form the duct; and feeding the plurality of pieces into the edge interlocking machine, and acting upon the at least one edge configuration so that it forms a seam with another piece to form a duct transition piece having the predetermined length.

2. A method as recited in claim 1 wherein said step of forming a plurality of pieces is accomplished by forming two different pieces that may be interlocked to form a duct.

3. A method as recited in claim 1 wherein said step of forming a plurality of pieces is accomplished by forming three different pieces that may be interlocked to form a duct.

4. A method as recited in claim 1 wherein said step of forming a plurality of pieces is accomplished by forming four different pieces that may be interlocked to form a duct.

5. A method as recited in claim 1 wherein said step of forming an edge configuration is accomplished by forming an edge configuration adapted to be bent to interlock with another piece.

6. A method as recited in claim 5 wherein said step of forming an edge configuration is accomplished by forming a pittsburgh edge configuration.

7. A method as recited in claim 1 wherein the edge interlocking machine includes four guide rails each mounted so that the ends thereof are vertically and horizontally moveable with respect to the ends of other of the guide rails; and comprising the further step of computer controlling the relative movements of the guide rail ends to automatically adjust the relative spacings to accommodate the ductwork transition pieces being fed thereto.

* * * * *